US006283405B1

(12) United States Patent
Tracy

(10) Patent No.: US 6,283,405 B1
(45) Date of Patent: Sep. 4, 2001

(54) DISPENSER FOR TRASH CONTAINER LINERS

(75) Inventor: Anthony S. Tracy, New York, NY (US)

(73) Assignee: Tracy Productions LLC, West Orange, NJ (US)

( * ) Notice: Subject to any disclaimer, the term of this patent is extended or adjusted under 35 U.S.C. 154(b) by 0 days.

(21) Appl. No.: 09/628,068

(22) Filed: Jul. 28, 2000

(51) Int. Cl.[7] ..... B65H 85/02; B65H 85/671

(52) U.S. Cl. ..... 242/588.4; 206/390; 206/395; 206/409; 220/407

(58) Field of Search ..... 242/588.4, 163, 242/170, 171, 159, 137, 137.1, 157 R; 206/388, 395, 409, 554, 494, 390, 410, 397; 220/404, 407, 23.83, 636, 630

(56) References Cited

U.S. PATENT DOCUMENTS 1,543,102 * 6/1925 Fleischer .
3,134,525 * 5/1964 Holcombe .
3,199,765 * 8/1965 Locke .
4,306,687 * 12/1981 Hadtke .
4,319,694 * 3/1982 Nehrbass et al. ..... 220/407
4,850,486 * 7/1989 Neibaur ..... 206/390
5,000,340 * 3/1991 Leggio ..... 220/407
5,183,157 * 2/1993 Darden ..... 206/390
5,353,950 * 10/1994 Taylor et al. ..... 220/407
5,358,113 * 10/1994 Hellenbrand ..... 206/409 X
5,503,292 4/1996 Cuccharia ..... 220/407
5,671,847 9/1997 Pedersen et al. ..... 206/554

* cited by examiner

*Primary Examiner*—William A. Rivera
(74) *Attorney, Agent, or Firm*—David L. Davis

(57) ABSTRACT

A dispenser for trash container liners including a rigid triangular box containing a supply of liners in the form of a cylindrical roll of a continuous strip of liners. The liners extend through an open slot in a side of the box and the innermost liner of the roll is securely attached to a cylindrical spindle on which the liners are wound. The box is detachably secured to the bottom of the trash container and the spindle is dimensioned so as not to pass through the slot. Accordingly, when the last liner in the box is used and removed from the container, the box is removed as well.

7 Claims, 4 Drawing Sheets

DISPENSER FOR TRASH CONTAINER LINERS

BACKGROUND OF THE INVENTION

This invention relates to a dispenser for trash container liners and, more particularly, to such a dispenser which can be placed at the bottom of a trash container without requiring any modification to the trash container.

It is fairly common to use plastic liners for lining the inside of trash containers or garbage cans. The liners are frequently packaged in boxes, or in rolls. A liner is removed from the box or roll and placed in the trash container to line its inside. After the liner is filled with trash, it is removed from the trash container and discarded, and a new liner is then removed from the package and inserted into the trash container. Typically, the packages of trash can liners are stored in a closet or on a shelf, and a new liner must be obtained from the package before insertion into the trash container.

U.S. Pat. No. 5,503,292 to Cuccharia discloses a specially designed trash receptacle wherein a roll of trash can liners is contained in a holder beneath the receptacle and liners are inserted in the receptacle through a slot in the bottom thereof. While useful for its intended purpose, such an arrangement requires a special two-part receptacle and liner holder. It would therefore be desirable to have a dispenser for trash container liners which does not require the use of a specially designed trash container.

U.S. Pat.No. 5,671,847 to Pedersen et al discloses a trash bag dispenser which is placed in the bottom of a trash container. The dispenser includes a flexible pouch containing a continuous strip of liners, which are removed one at a time from the pouch while remaining removably secured to the following liner in the pouch. However, when the liner lining the trash container is filled, its weight presses down on the pouch, crushing it and interfering with its utility. It would therefore be desirable to have a dispenser for trash container liners which does not suffer from any of the deficiencies noted above.

SUMMARY OF THE INVENTION

According to the present invention, there is provided a dispenser for trash container liners which comprises a rigid box having a longitudinal axis and three sides when viewed in section transverse to the longitudinal axis. One of the sides is formed with an open slot elongated in a direction parallel to the longitudinal axis. A supply of liners is contained within the interior of the box. The supply of liners is in the form of a continuous strip of liners separated one from the next by a line of perforations. Accordingly, the liners are removable from the box one-by-one through the open slot. The triangular nature of the box acts to distribute the weight of a filled liner without crushing the box.

In accordance with an aspect of this invention, the continuous strip of liners is formed as a cylindrical roll of liners having an axis parallel to the longitudinal axis of the box.

In accordance with another aspect of this invention, the dispenser further includes means for detachably securing a selected side of the box to the inside bottom of a trash container.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
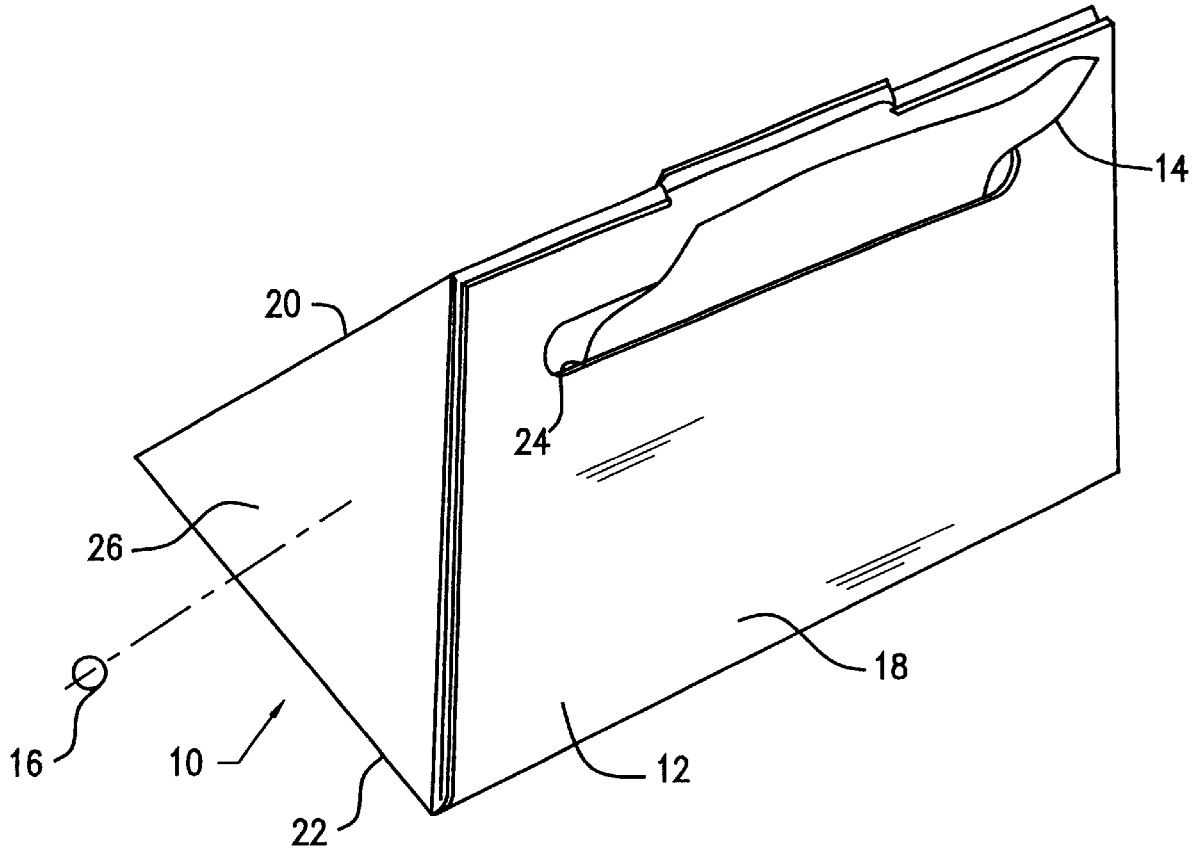
FIG. 1 is a perspective view of a dispenser constructed according to the present invention.
Figure 3:
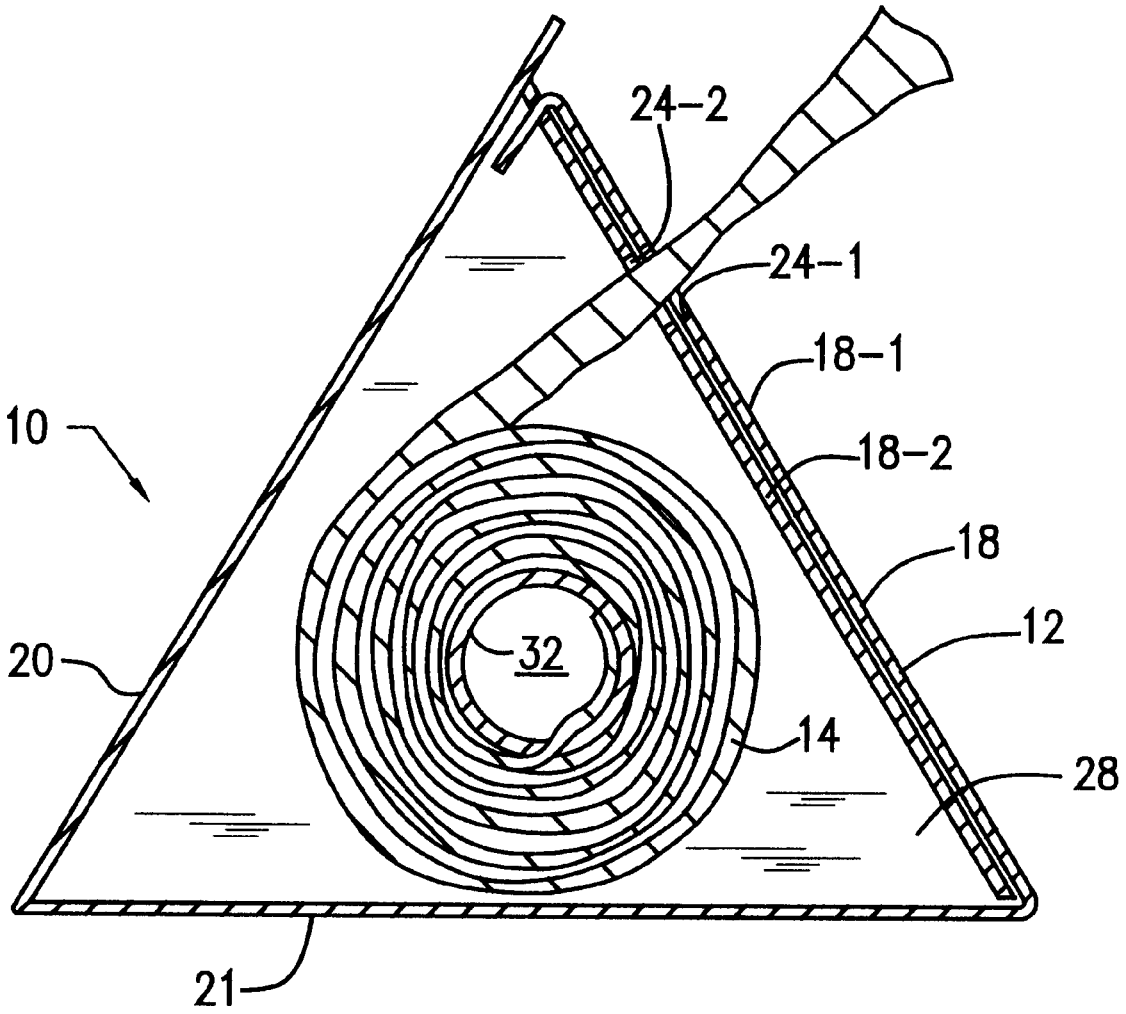
FIG. 3 is a cross sectional view of the dispenser shown in FIG. 1.

Referring now to the drawings, FIG. 1 shows a dispenser, designated generally by the reference numeral 10, constructed in accordance with the present invention. The dispenser 10 includes a rigid box 12 and a supply of plastic liners 14 within the box 12. As shown, the box 12 has a longitudinal axis 16 and when viewed in section transverse to the axis 16, as shown in FIG. 3, the box 12 has three sides 18, 20, and 22. The side 18 of the box 12 is formed with an open slot 24 through which the liners 14 can be removed from the interior of the box 12.

Figure 2:
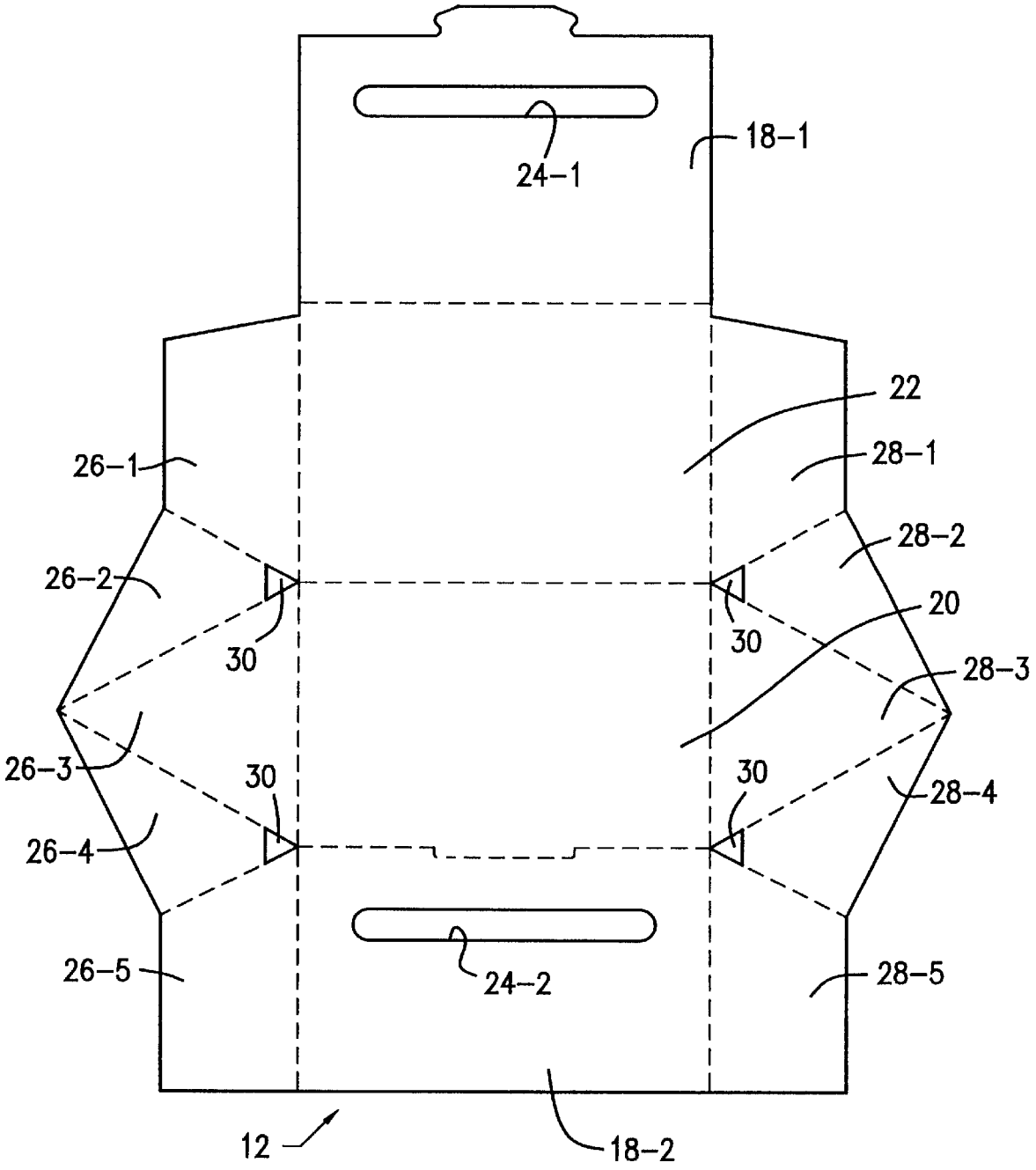
FIG. 2 is a plan view showing a sheet cut out to form the box of the dispenser shown in FIG. 1, with the fold lines being shown as broken lines.

Preferably, the box 12 is formed from a stiff corrugated cardboard material which, as seen from FIG. 2, is of unitary construction, being cut and folded from a single sheet of material. Accordingly, while the single panels 20 and 22 make up the two correspondingly numbered sides of the box 12, the panels 18-1 and 18-2 overlie one another, as best seen in FIG. 3, to make up the side 18 of the box 12. The slot 24 is formed from the slots 24-1 and 24-2 formed in the panels 18-1 and 18-2, respectively, which are in registration with each other to form the overall slot 24. The panels 26-1, 26-2, 26-3, 26-4 and 26-5 make up a first end 26 of the box 12 and the panels 28-1, 28-2, 28-3, 28-4 and 28-5 make up a second end 28 of the box 12. The triangular cutouts 30 provide space when making the folds for the ends 26, 28.

The liners 14 are conventionally manufactured as a continuous strip, wherein the bottom of one liner is separated from the top of the next liner in the strip by a line of perforations, so that individual liners can be separated from the strip. The strip of liners is then pleated and formed into a cylindrical roll. Preferably, a cylindrical spindle 32 is provided and the continuous strip of liners 14 is wound thereon. Also preferably, the innermost liner is firmly secured to the spindle 32, as by adhesive, staples, or the like. For assembly, the roll of liners 14 is placed on one of the panels 20, 22 and the box 12 is folded thereabout, so that the axis of the cylindrical roll of liners 14 is parallel to the longitudinal axis 16 of the formed box 12. Also preferably, the open slot 24 is elongated in a direction parallel to the axis 16.

Figure 5:
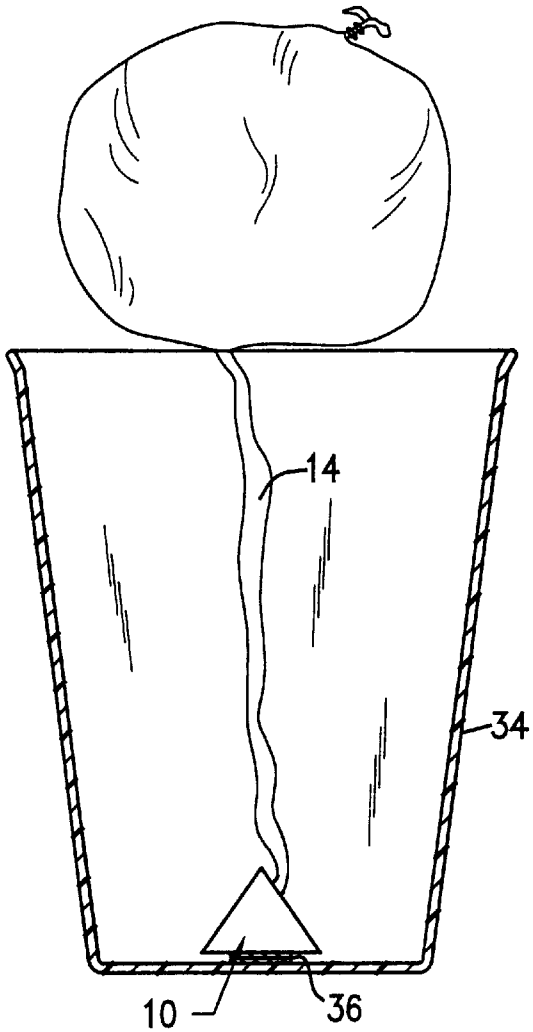
FIG. 5 is a view similar to FIG. 4 showing a filled liner being removed from the trash container with a subsequent liner being pulled from the dispenser.
Figure 4:
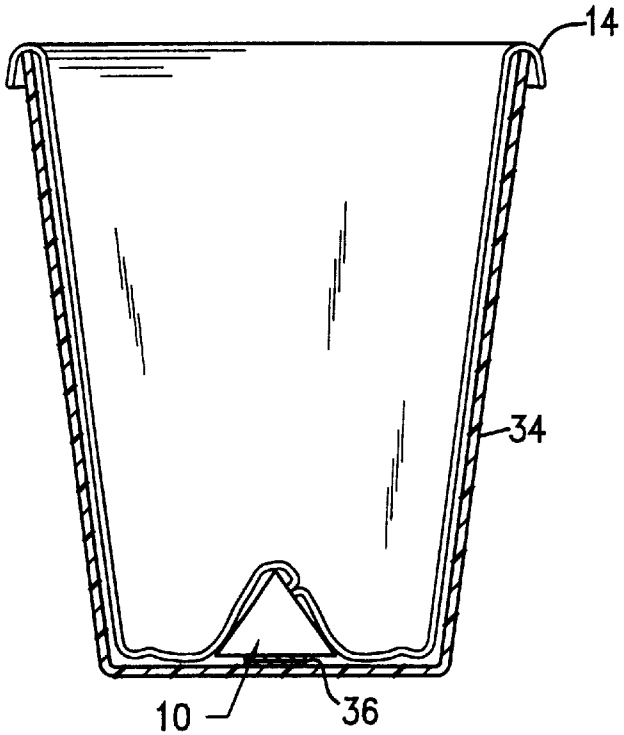
FIG. 4 is a view showing the dispenser according to the present invention mounted at the bottom of a trash container, shown in section, with a liner disposed for use.

In use, as shown in FIGS. 4 and 5, the dispenser 10 is placed at the bottom of a trash container 34. Preferably, a side of the dispenser 10 other than the side 18 having the slot 24 is detachably secured to the inside bottom of the container 34, illustratively by an adhesive backed hook and loop fastener set 36. With the dispenser 10 at the bottom of the container 34, a single liner can be pulled out of the box 12 through the slot 24 and its open end is draped over the open top of the container 34 so as to provide a liner for the container 34. As the liner 14 is filled, the waste material contained therein slides down the sides of the box 12, thereby distributing the weight of the trash in a better manner than if the dispenser were flat. After the liner 14 is filled, its top is closed and the entire liner is lifted from the container 34. Since the bottom of that liner is attached to the top of the next liner in the roll, the next liner is pulled from the box 12. The filled liner and the fresh liner may then be separated one from the other at the line of perforations therebetween, and the top of the next liner may then be draped over the top of the container 34, as shown in FIG. 4.

Preferably, the spindle 32 is dimensioned so that it cannot pass through the slot 24 of the box 12. Therefore, when the innermost liner of the dispenser 10 is filled and pulled out of the container 34, since its bottom is firmly secured to the spindle 32 and the spindle 32 cannot pass through the slot 24, the box 12 is removed from the bottom of the container 34 by separation of the loop fastener set 36. Thus, removal of the last liner results in removal of the empty box. A fresh dispenser may then be installed in the trash container.

Accordingly, there has been disclosed an improved dispenser for trash container liners. While a preferred embodiment of the present invention has been disclosed herein, it will be appreciated by those of skill in the art that various adaptations and modifications to the disclosed embodiment are possible, and it is therefore intended that this invention be limited only by the scope of the appended claims. Thus, the present invention can be manufactured in many different sizes, to fit different sized conventional trash containers, without requiring the use of a specially designed container.

What is claimed is:

1. A dispenser for trash container liners, comprising:

a rigid box having a longitudinal axis and a triangular cross section when viewed in section transverse to said longitudinal axis, each of said sides being formed from at least one panel of sheet material, wherein one of said sides is formed with an open slot extending through the at least one panel forming said one of said sides, said open slot being elongated in a direction parallel to said longitudinal axis; and a supply of liners contained within the interior of said box, said supply of liners being in the form of a continuous strip of liners separated one from the next by a line of perforations;

whereby the liners are removable from the box one-by-one through the open slot.

2. The dispenser according to claim 1 wherein the continuous strip of liners is formed as a cylindrical roll of liners having an axis parallel to the longitudinal axis of the box.

3. The dispenser according to claim 2 further including a cylindrical spindle, wherein the roll of liners is wound on the spindle.

4. The dispenser according to claim 3 wherein the innermost liner of the roll of liners is firmly secured to the spindle.

5. The dispenser according to claim 4 wherein the spindle is dimensioned so that it cannot pass through the open slot of the box.

6. The dispenser according to claim 1 further comprising:

means for detachably securing a selected side of the box to the inside bottom of a trash container.

7. The dispenser according to claim 6 wherein the means for detachably securing includes a hook and loop fastener set.

* * * * *